US005192025A

United States Patent [19]

Hu et al.

[11] Patent Number: 5,192,025

[45] Date of Patent: Mar. 9, 1993

[54] ELECTRIC WATER JET FOR AUTOMOBILE

[76] Inventors: Ming-Thy Hu; Yun-Wen Hwang, both of 3 Fl., No. 11, 62 Lane, Wan-Lung St., Chin-Mei District, Taipei; Min-Shang Hwang, 5 Fl., No. 12, 393 Lane, Chung-Shan Rd., Hsinchu; Eong-Chau Sheen, No. 19, 60 Lane, Jen-Ai St., Chin-Tung Tsun, Lin-Chia Village, Tainan Hsien, all of Taiwan

[21] Appl. No.: 733,193

[22] Filed: Jul. 19, 1991

[51] Int. Cl.[5] ..... B05B 9/03

[52] U.S. Cl. ..... 239/394; 239/526; 239/289

[58] Field of Search ..... 239/332, 289, 526, 23, 239/394

[56] References Cited

U.S. PATENT DOCUMENTS

| | | | |
|---|---|---|---|
| 3,393,643 | 7/1968 | Herman | 239/23 |
| 3,496,901 | 2/1970 | Stanfield et al. | 239/23 |
| 3,497,185 | 2/1970 | Dively | 239/23 |
| 4,699,597 | 10/1987 | Oja | 239/289 |
| 4,801,088 | 1/1989 | Baker | 239/332 |
| 5,011,372 | 4/1991 | Nigrelli et al. | 239/23 |
| 5,100,058 | 3/1992 | Wei | 239/332 |

*Primary Examiner*—Andres Kashnikow

*Assistant Examiner*—Karen B. Merritt

*Attorney, Agent, or Firm*—Bacon & Thomas

[57] ABSTRACT

An electric water spray gun system is disclosed having a floatable intake device with a body made of light-weight material in the form of a high-stem bowl with a plurality of weight rings engaging the stem portion by threads for adjustment of its center of gravity by adjusting the position and/or number of such weight rings. The intake device also has a filter ring with a number of filter elements of different screen sizes arranged over an opening at the lower end of the stem portion which serves as an inlet port, a d.c. motor installed at the upper section of a passage within the body, a lower section serving as a water inlet passage, a first vane fixed to the drive shaft of the d.c. motor, and a check valve at a water outlet port located beside the passage for pumping water from any water source to an electric spray gun. The spray gas is composed of a gun body with an "L" shaped water passage having a water inlet port at one end and a water outlet port at another end, a d.c. motor located in the water passage, and a second vane fixed to the drive shaft of the d.c. motor to pump and change the direction of water flow 90 degrees. All the d.c. motors are controlled by a switch located on the handle of the spray gun.

2 Claims, 3 Drawing Sheets

ELECTRIC WATER JET FOR AUTOMOBILE

BACKGROUND OF THE INVENTION

The present invention relates to an electric water spray gun, particularly an electric water spray gun which makes use of a power source in any automobile to pump water from any water source to provide high pressure water without impurities such as sludge. It is a device which can be used conveniently.

Generally, a water spray gun is connected to a tap of city water to provide water flow simply with the inherent water pressure of city water. If high water pressure is required, it is necessary to install a large water tank at the roof. Such a water spray gun can provide high water pressure if the inherent water pressure is low, such as that at the end of city water distribution pipeline, or at the river side. In some occasions, it is necessary to get water manually. Moreover, waste of water may occur for there is no means to stop the water flow in the conventional water spray gun. Therefore, there is need of a convenient device to pump water from a river or stream in outdoor activities or for car washing.

SUMMARY OF THE INVENTION

The main objective of the present invention is to provide an electric water spray gun for an automobile comprising a floatable intake device, an electric spray gun and a hose to pump and spray water from any water source, such as river or stream with a d.c. power source available from the automobile.

Another objective of the present invention is to provide an electric water spray gun for an automobile wherein the floatable intake device has a d.c. motor to pump the water, a filter to remove impurities, and a number of weight rings to adjust its center of gravity so that it can keep floating on water.

Another objective of the present invention is to provide an electric water spray gun for an automobile wherein the spray gun has a d.c. motor to pump and spout water, and uses replaceable nozzles, such as water jet type nozzle or a shower type nozzle for different purposes.

Another objective of the present invention is to provide an electric water spray gun for pumping water from any indoor or outdoor water sources.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENTS

Figure 1:
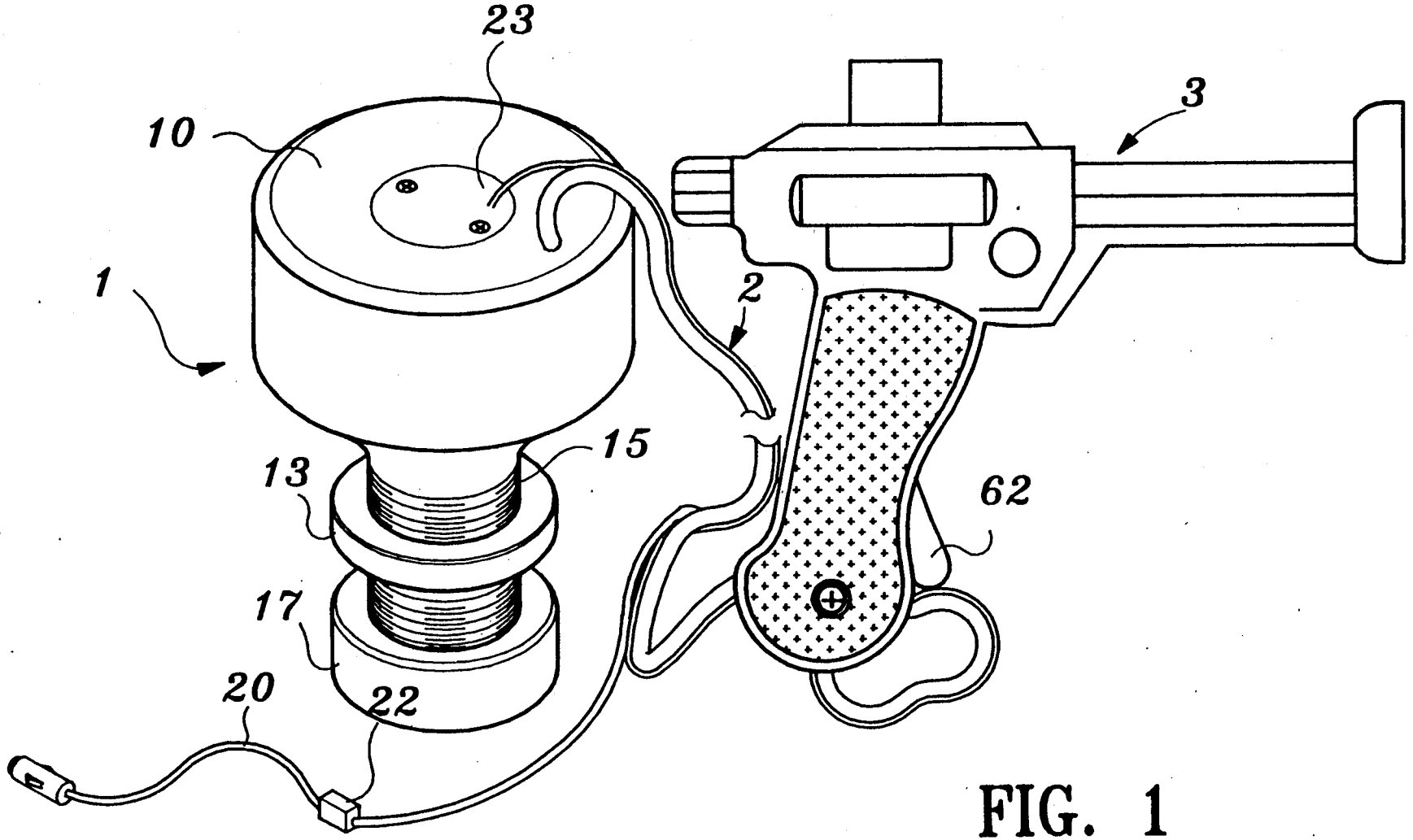
FIG. 1 is a perspective view of the electric water spray gun for an automobile according to the present invention.
Figure 2:
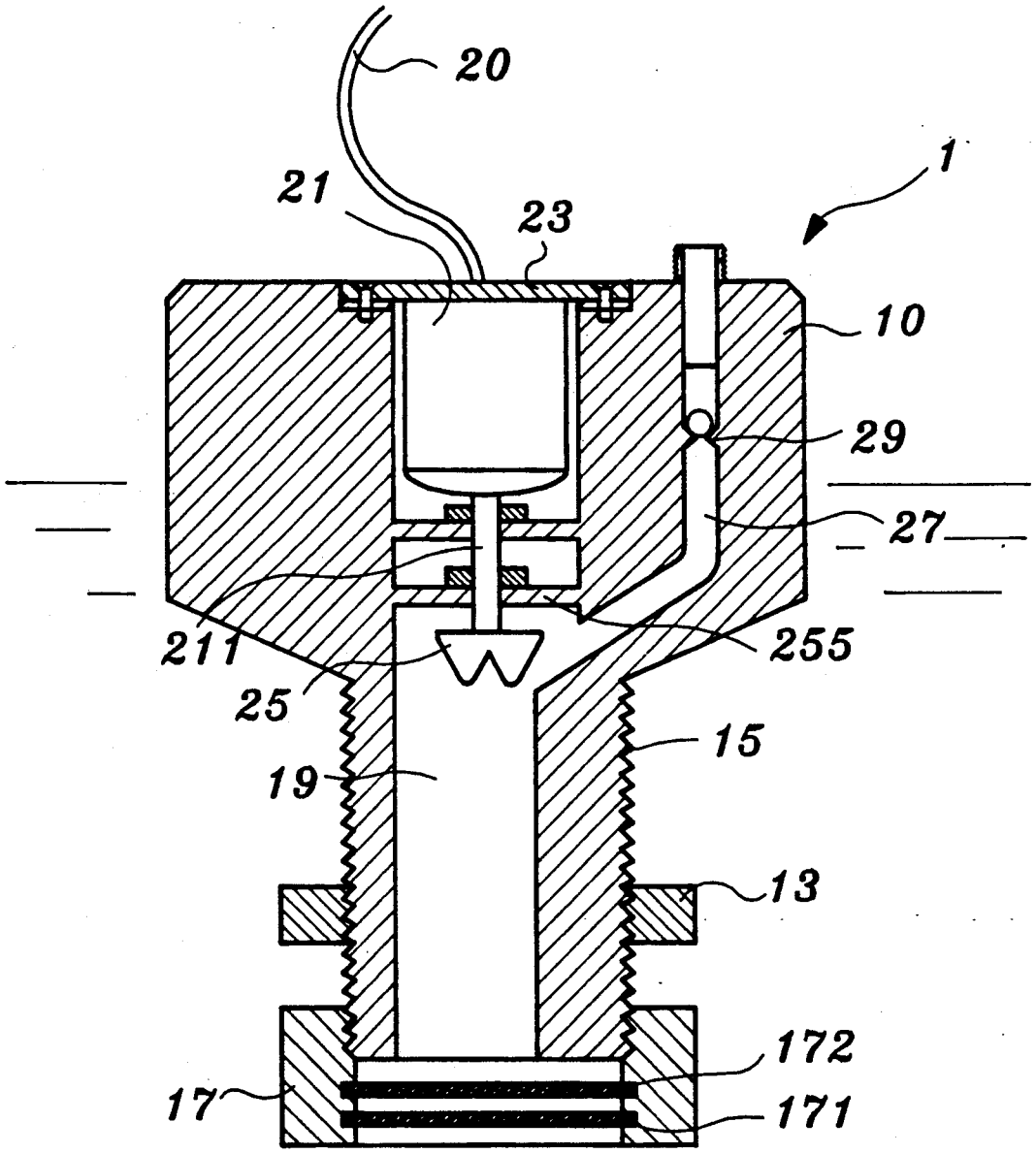
FIG. 2 is a cross-sectional view of the floatable intake device in the electric water spray gun for an automobile according to the present invention.
Figure 3:
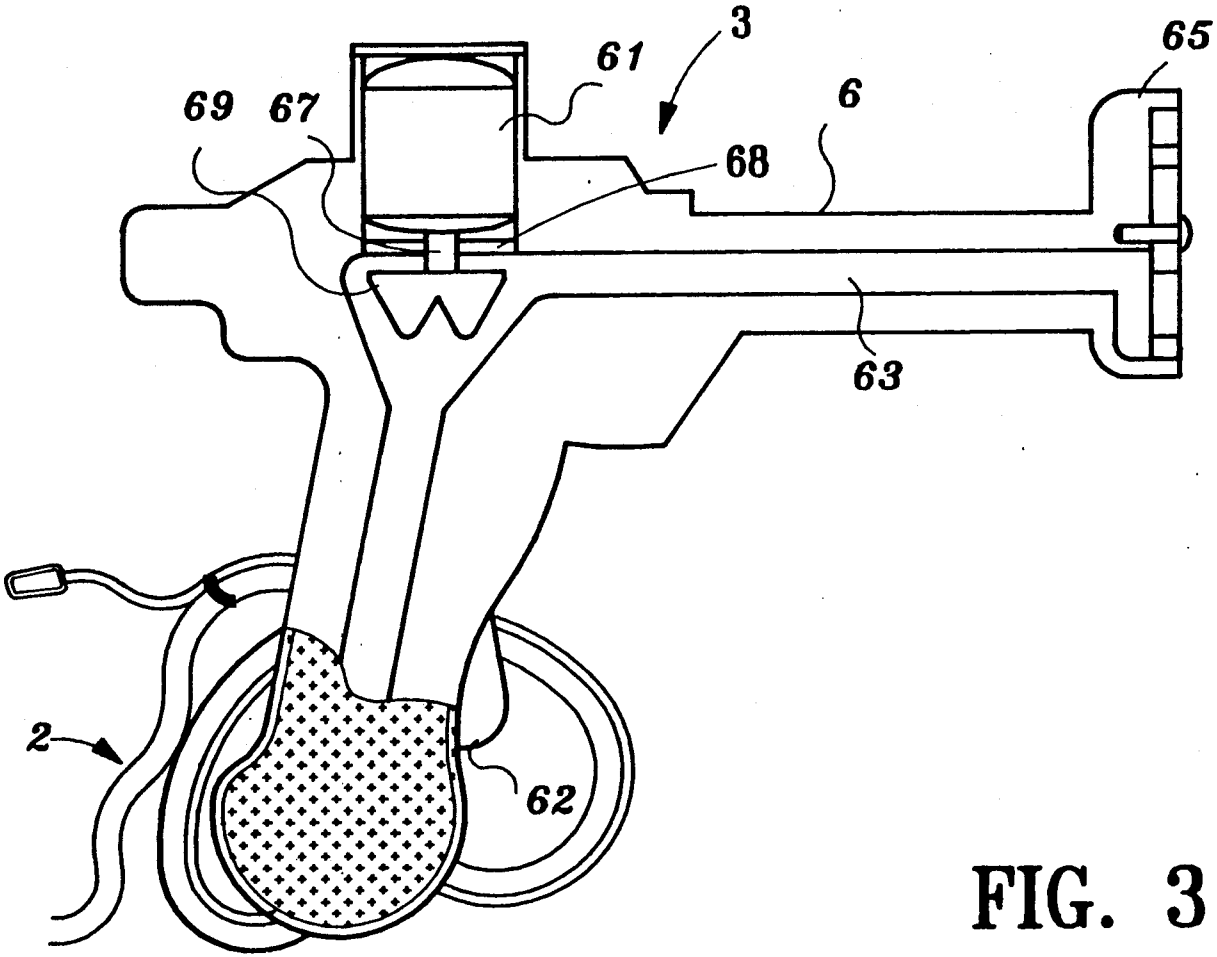
FIG. 3 is a cross-sectional view of the electric spray gun according to the present invention.

As shown in the attached drawings, the electric water spray gun for an automobile according to the present invention comprises a floatable intake device (1), a hose (2), and an electric spray gun (3). The floatable intake device (1) has a body (10) in the form of a high-stem type bowl made of light-weight material such as acrylic or rubber, or light-weight material filled with sponge or other floatable material so that the intake device (1) can float on water in such a way that the stem portion (15) remains in the water. At the stem portion (15) there is a male thread for holding a plurality of weight rings (13) formed with female threads. By adjustment of the quantity and/or the positions of such weight rings (13) on the stem (15), the length of the stem remaining in the water can be adjusted according to the depth of the water to be sucked. At its water inlet port the intake device (1) has a ring type filter (17) fixed to the lower end of the stem portion (15) by the male thread at the stem portion and a female thread on the ring type filter (17). A fine filter element (172) is located on the ring-type filter (17) and a coarse filter element (171) is located below the ring type filter (17) to remove foreign particles from the water flowing into the intake device (1) in order to prevent clogging of the water inlet port or inlet channel (19). Above the inlet channel (19) there is a space for installation of a d.c. motor (21) which is attached there by means of a retention plate (23). An end of the shaft (211) of the d.c. motor (21) is fixed to a vane, called the first vane (25), preferably a four- or six-blade type centrifugal vane. An outlet channel (27) with a check valve (29) therein is defined at a side of the body (10) to connect to the location of the first vane (25) to the hose (2). There is a wall (255) between the first vane (25) and the d.c. motor (21). When the power cord (20) for the d.c. motor (21) is connected to d.c. power source on any car, the d.c. motor can be started, to rotate the first vane (25), by turning on switch (22) on the power cord (20). Whenever the intake device (1) is placed in a water source, water is pumped by the first vane (25) into the inlet channel (19) after filtration by the two filter elements the ring-type filter (17) and then discharged from the outlet channel (27) with check valve (29) to prevent reverse flow. In this way, water is guided to the hose (2). The spray gun (3) is in the form of a gun having a gun body (6) defining a water passage (63). One end of the water passage (63) is connected to the hose (2), and another end to a nozzle (65). The nozzle (65) is in the form of a rotary wheel with its center fixed to the spray gun body. The rotary wheel is designed with a plurality of injection holes of different diameters, in the form of a shower for different purposes. The water passage (63) is designed in an "L" shape with a space in the turning point of the "L" provided for installation of a second d.c. motor (61). The drive shaft (67) of the second d.c. motor (61) is engaging with the second vane (69). There is a wall (68) between the second vane (69) and the d.c. motor II (61) so that water is pumped by the second vane (69), turned 90 degrees and is then sprayed out through the nozzle (65) at high speed. The water so sprayed out is in the form of mist at high pressure, and hence the present invention is more effective than the conventional water spray gun. The power cord used in the present invention can be fixed to the hose (2) and then connected to a power source.

The present invention can be used at any place where there is a water source simply by connecting the power cord to d.c. power source such as cigarette lighter in car. The d.c. motors can be started simply by turning on a switch (62) attached to the handle of the spray gun and then water can be pumped. Use of the present invention is much more convenient than the conventional water pump. As the present invention has a floatable intake device (1), no installation work is required, only adjustment of the weight rings to control water pumping position. The pumping action provides the water flow with a considerable pressure which is higher than that from a siphon by several times. Moreover, it has a filter to remove impurities in the water. It is indeed a structure and easy to useful and compact tool having a simple structure and one which is easy to use.

As indicated, the structure herein may be variously embodied. Recognizing various modifications will be apparent, the scope hereof shall be deemed to be defined by the claims as set forth below.

We claim:

1. An electric water spray gun system comprising:

a) a floatable intake device having a body made of light-weight material having a stem portion extending therefrom; a plurality of weight rings engaging the stem portion by threads for adjustment of the center of gravity of the floatable intake device by adjusting at least one of the position and number of such weight rings; a filter ring having a plurality of filter elements of different filtration sizes arranged thereon so as to cover an opening defined at a lower end of the stem portion which opening serves as an inlet port; a first d.c. motor located in an upper section of a passage defined within the body, a lower section of the passage serving as a water inlet passage and an upper section serving as a first water outlet port; a first vane fixed to a drive shaft of the first d.c. motor; a first wall between the first vane and the first d.c. motor; a check valve located in the passage at the first water outlet port; a retention plate to attach the first d.c. motor to the body; and a power cord extending from the first d.c. motor and adapted to engage a d.c. power source;

b) an electric spray gun having a gun body defining a generally "L" shaped water passage with a second water inlet port at one end and a second water outlet port at another end; a second d.c. motor located at the turning point of the water passage; a second vane fixed to a drive shaft of the second d.c. motor to pump and change direction of water flow approximately 90 degrees; a nozzle adjacent to the second water outlet port to spray out the water from the outlet port; a second power cord extending from the second d.c. motor and adapted to engage a d.c. power source; and c) a hose connecting the first water outlet port of the floatable intake device to the second water inlet port of the spray gun.

2. An electric water spray gun system as claimed in claim 1 wherein the spray gun further comprises a handle having a switch to turn on and off the first and second d.c. motors; and wherein the nozzle comprises a wheel defining injection holes of different diameters.

* * * * *